US005370547A

United States Patent [19]

Daoud

[11] Patent Number: 5,370,547

[45] Date of Patent: Dec. 6, 1994

[54] HASP MECHANISM

[75] Inventor: Bassel H. Daoud, Parsiappany Township, Morris County, N.J.

[73] Assignee: AT&T Corp., Murray Hill, N.J.

[21] Appl. No.: 167,594

[22] Filed: Dec. 14, 1993

Related U.S. Application Data

[62] Division of Ser. No. 987,938, Dec. 9, 1992, Pat. No. 5,312,266.

[51] Int. Cl.[5] ..... H01R 13/447

[52] U.S. Cl. ..... 439/304

[58] Field of Search ..... 439/304, 133, 136, 142, 439/144; 379/399, 438, 445; 70/57, 58, DIG. 30; 200/43.14–43.22

[56] References Cited

U.S. PATENT DOCUMENTS 4,911,646 3/1990 Marson et al. ..... 439/133
5,312,266 5/1994 Daoud ..... 439/304

FOREIGN PATENT DOCUMENTS 1451954 10/1976 United Kingdom ..... 200/43.22

*Primary Examiner*—Neil Abrams

*Attorney, Agent, or Firm*—Ruloff F. Kip, Jr.

[57] ABSTRACT

A building entrance protector unit includes plurality of electrical connectors providing electrical connections between wire pairs leading from telephone stations of subscribers in the building and wire pairs from the local telephone networks serving the unit, these connections being interruptible by the subscribers for the purpose of plugging in their telephone sets to the network to test these sets. The connections are tamperproofed by a hasp mechanism providing hasp leaves respective to these connectors and each lockable in a first position impeding access to the corresponding connection by attachment of a padlock to a hasp staple projecting through that leaf. That locking may be overridden by a telephone network technician by a releasing from a held position of a common mounting for all the hasp staples. The staples are hook shaped so that, upon such releasing, a closed padlock can be removed from any staple by closing relative movement between the mounting for the staple and the leaf through which such staple projects. The hasp leaves are plastic and at their held ends have partly open resiliently expandable sockets adapted to fit over and be removed from a hinge pin by snap fitting action.

5 Claims, 8 Drawing Sheets

HASP MECHANISM

This is a division of application Ser. No. 07/987,938 filed Dec. 9, 1992, now U.S. Pat. No. 5,312,266, issued May 17, 1994.

FIELD OF THE INVENTION

This invention relates generally to apparatus for providing electrical connections between wires or other electrical conductors and, more particularly, to apparatus of such kind in which such electrical connections are rendered tamperproof in the sense that unauthorized access to such connections is impeded.

BACKGROUND OF THE INVENTION

Apartment houses now have or are having installed therein items of telecommunications equipment which are known as building entrance protectors ("BEP's"), and which among other functions, serve to safeguard telephone sets in the building from voltage surges produced by lightning or other causes. These BEP's contain connectors which provide interfaces between the telephone networks and individual subscribers in the sense that through those connectors are made interruptible electrical connections between tip and ring wire pairs from the network and tip and ring wire pairs from the telephone stations of those subscribers.

Such connectors in a BEP are, however, capable of being misused by unscrupulous persons if left unguarded. For example, with such connectors being freely accessible to all tenants in the apartment house, a first telephone subscriber in the building may well be able to meddle with the connectors so as to connect the wire pair from his station to the wire pair from the network assigned to a second subscriber and, thereby, have telephone calls made by the first subscriber charged to the second subscriber.

Accordingly, it is necessary to secure the connectors against unauthorized access. This has been done in the past by providing for each of the connectors in the BEP assigned to a particular subscriber, a separate hasp device which that subscriber locks by a padlock in a position restricting access by others to the connector or which, alternatively, the subscriber can unlock, by removal of the padlock, in case the subscriber has need to get at the connector. That past arrangement for avoiding tampering with a particular electrical connector has, however, the disadvantages among others that, if it is necessary for a telephone company repair man to have access to a connector secured by a hasp device locked by a subscriber, the repairman cannot by himself override the access blocking effect of the hasp device and, moreover, if the subscriber vacates his apartment without removing his padlock from the connector assigned to him, there is no way for the repair man to unlock the hasp device except by sawing off the padlock thereon.

SUMMARY OF THE INVENTION

One or more of the mentioned disadvantages of such past arrangement for restricting unauthorized access to an electrical connector are overcome according to the invention in one of its aspects by providing tamperproof interconnection apparatus comprising, connector means for providing an interruptible electrical connection between first and second electric wires when coupled thereto, access control means selectably movable between a first position at which said means is at the location of said connector and impedes access thereto and a second position at which said means is away from that connector, and fastening means to which is attachable a padlock by closing of such padlock on that means, said fastening means having an enabled condition and a disabled condition in which, respectively, said fastening means with a padlock thereon locks said access control means in said first position and said fastening means is incapable of so doing, and said apparatus further comprising override means selectably operable to change said fastening means between said enabled condition and said disabled condition. By utilizing that override means to shift such fastening means from enabled to disabled condition, a repair man can gain access to a connector to perform service thereon even though access to the connector had previously been blocked by a subscriber's locking of the fastening means in its first position.

DETAILED DESCRIPTION

For a better understanding of the invention, reference is made to the following description of a representative embodiment thereof, and to the following drawings wherein.

Figure 1:
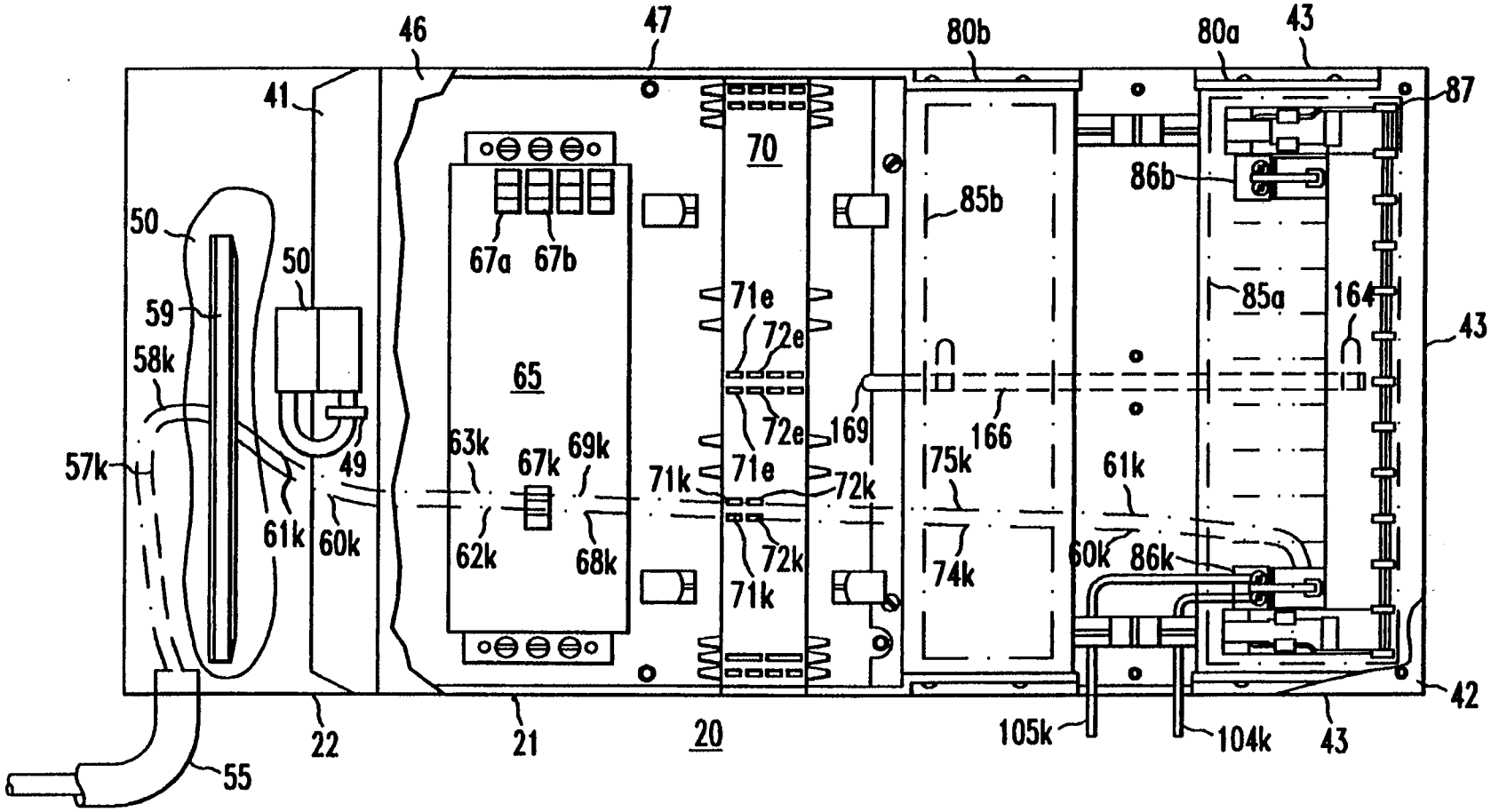
FIG. 1 is a plan view, partly in cross-section and cut away, of an exemplary embodiment of a building entrance protector unit according to the invention.

In the description which follows elements which are counterparts of each other will be designated by the same reference numerals with different alphabetical suffixes being used for the respective counterparts, and it is to be understood that, unless the context otherwise indicates, a description of one of such elements is to be taken as applying also to all its counterparts.

Figure 2:
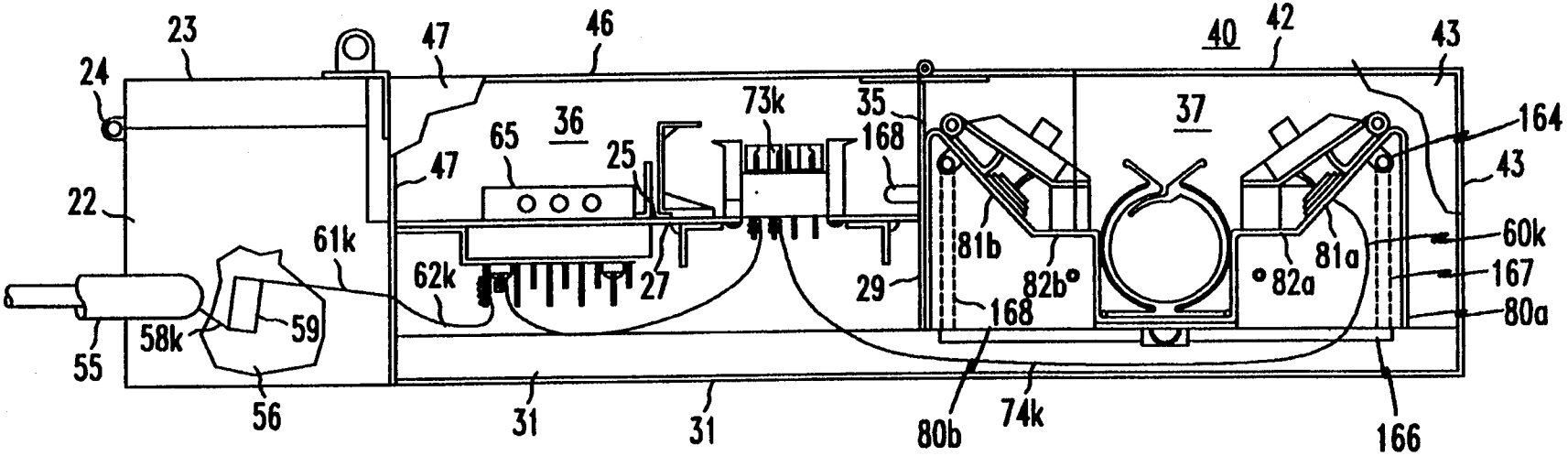
FIG. 2 is a front elevation, partly in cross-section and cut-away of the FIG. 2 unit.

Referring now to FIGS. 1 and 2, the reference numeral 20 designates a building entrance protector unit according to the invention. The components of unit 20 are housed within a sheet metal container 21 comprising a base in the form of a longitudinally elongated rectangular box 21 having a leftward part constituting a splice chamber 22 openable and closeable at its top by a lid 23 coupled to the box 21 by a leftward hinge 24. From chamber 22 the box steps down to the right to a first shelf 25 and then to a second lower shelf 26 provided by respective horizontal walls 27 and 28 which, together with a vertical transition wall 29 between them, provide closures over the top for an interior space 30 contained in box 20 to the right of chamber 22. Space 30 serves as a routing space for the unit 20.

Transition wall 35 is continued upward, in effect, by a vertical partition 35 (FIG. 2) extending laterally across container 21 and dividing the BEP unit 20 into a network section 36 and a subscriber section 37 disposed to the left and right, respectively, of the partition. Those sections are so named because section 36 of me unit is ordinarily accessible only to personnel of the telephone network to which unit 20 is coupled, whereas section 37 is also accessible to telephone subscribers in the building in which unit 20 is located. The unit 20 thus provides an interface between such network and the stations for telephone sets of those subscribers.

In the network and subscriber sections 36 and 37, the horizontal walls 27 and 28 defining the shelves 25 and 26 provide support means for various components of unit 20 included in those sections. Disposed above shelf 26 is a cover 40 hinged at its mar to the top of partition 35 and having a flat top 42 and flaps 43 downstanding therefrom at the laterally opposite sides and front of the cover. Cover 40 is pivotable about its hinged coupling with the partition to either completely enclose the space above shelf 26 or to open that space to access. A similar cover 45, disposed above shelf 25, is hinged at its rear to partition 35, has a flat top 46 and flaps 47 downstanding from the laterally opposite and front of that top, and is likewise movable about its hinged coupling with the partition between up and down positions at which, respectively, cover 45 permits access to the space above shelf 25 of network section 36, and the cover encloses that space to cut off access to any elements therein. At its front, the cover 45 carries a leftwardly projecting tab 48 having formed therein a slot (not shown) through which passes a hasp staple 49 mounted on the lid 23 for splice chamber 22. Both lid 23 and cover 45 may be locked in down position by attaching to and closing on staple 49 (FIG. 1) a padlock 50 of which the key is kept exclusively by personnel of the telephone network.

A cable 55 which is part of the mentioned network passes through an opening in the side of splice chamber 22 and into the interior 56 of that chamber. The cable 55 encases numerous pairs of tip and ring wires of which the shown paired tip wire **57*k* and ring wire 58*k* are exemplary. The wire pairs 57, 58 which are components of the cable are connected via a connector 59 in space 56 (and known as a type "710" connector) to respective pairs of electrical conductor means (60, 61 which are local to unit 20 and extend from connector 59 in network section 36 into the subscriber section 37, and of which exemplary ones are the paired conductor means 60*k*, 61*k* coupled via connector 59 to the cable wire pair 57*k*, 58*k***.

Electrical conductor means **60*k*, 61*k* comprise (a) wire pairs 62*k*, 63*k* passing from splice chamber 22 through muting space 30 to a bank 65 of voltage surge protective devices 67 (respectively corresponding to the mentioned pairs of conductor means) and, in particular, to the input terminals of such a protective device 67*k* in that bank, (b) wire pairs 68*k*, 69*k* extending from output terminals of device 67*k* through space 30 to a cross-connect field 70 (consisting of pairs of input terminals 71 and matching pairs of output terminals 72 respectively corresponding to the conductor means 60, 61 and connectable, one to the other, by bridging clips 73) and, in particular, to input terminals 71*k* of field 70 connected by bridging clips 73*k* to output terminals 72*k* of field 70, and (c) insulated wire pairs 74*k*, 75*k* extending from terminals 72*k* in network section 36 through space 30 into subscriber section 37 to the ends of the conductor means 60*k*, 61*k* in that section. By virtue of being constituted as described above, each of the paired conductor means provides a normally unbroken electroconductive path from the left hand termination of those conductor means at connector 59 in splice chamber 22 to the right hand terminations of those conductor means in subscriber section 37**.

The voltage surge protective devices 67 interposed in conductor means 60, 61 perform the function of reducing below hazardous level in the wiring to the right of such devices any voltage surges appearing in such wiring to the left of such devices and transmitted to such wiring from the telephone network as a result of, say, lines in the network being struck by lightning. The cross-connect field 70 interposed in conductor means 60, 61 permits flexibility in the electrical connections made between the local wire pairs 74, 75 leading to subscriber section 37 and the local wire pairs 68, 69 from the protective devices 67. That is, for example, although normally a "through" connection is made by the use of bridging clips **73*k* between wires pair 74*k*, 75*k* and wire pairs 68*k* 69*k* from protective device 67*k*, occasions may arise when it would be desirable to connect wire pairs 74*k*, 75 to some other protective device, and this can be done in cross-connect field 70 by the use therein in a well known manner of jumper leads in place of the normally used bridging clips 73**.

The unit 20 in addition to containing paired conductor means **60*k*, 61*k* also has numerous other similar paired conductor means 60, 61 extending from subscriber section 36 to couplings in chamber 22 and through connector 59 to respectively corresponding pairs of tip and ring wire pairs 57, 58 which are constituents of cable 55**.

Considering now in more detail the subscriber section 37, that section has therein a plurality of hollow sheet metal pedestals mounted on horizontal shelf wall 8 over openings (not shown) in that wall so that the interiors of those pedestals communicate with the routing space 30. FIGS. 1 and 2 show two of such pedestals **80*a* and 80*b* having respective peaks from which respective inclined top walls 81*a*, 81*b* slope down to horizontal platforms 82*a*, 82*b* at the foot of those slanting walls. Subscriber section 37 may include one or more additional pedestals 80 similar to pedestals 80*a*, 80*b*** except, if desired, being longitudinally twice as large and having center peaks from which top walls slope in both longitudinal directions away from such peaks to horizontal platforms at the bottoms of such walls.

The pedestals provide respective support means for two interconnection assemblies **85*a*, 85*b* which are essentially similar so that only assembly 85*a*** will be described in detail.

Assembly **85*a* comprises (a) a laterally extending row of electrical connectors 86 carried by pedestal 80*a*, and (b) a hasp mechanism 87 carried by that pedestal and having some parts common to such connectors and other parts respectively corresponding thereto. While the mentioned lateral row of connectors may consist of, say, twelve of them, only the connectors 86b and 86k are shown in FIG. 1. Others, however, of such connectors are shown in FIGS. 5–8**.

Figure 10:
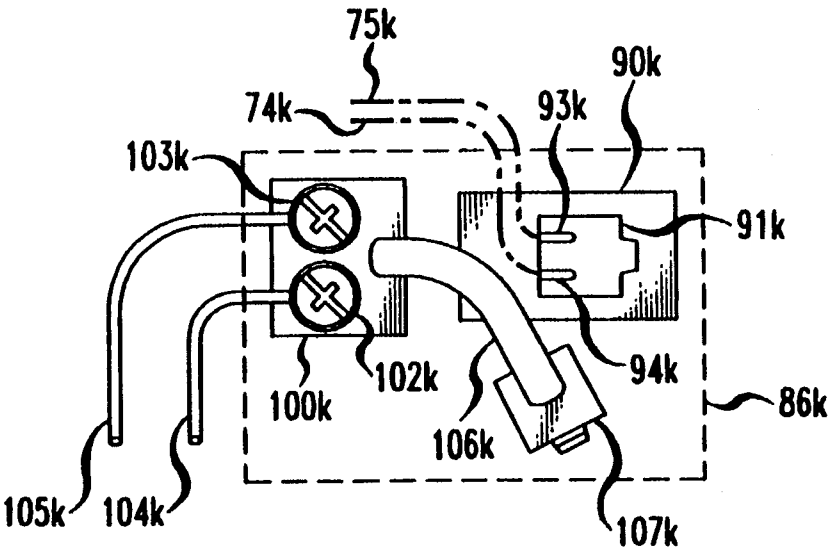
FIG. 10 is a plan view of one of the electrical connectors included in the mentioned interconnection assembly of the FIG. 1 unit.

Referring now to FIG. 10 showing connector 86k which is exemplary of all the others in the interconnection assemblies in unit 20, that connector comprises a first insulative case 90k mounted on the slanting top wall of pedestal 80a and containing a standard modular telephone jack 91k. The jack 91k has therein connectors 94k, 95k of pin type embedded in the case 90k and electrically coupled to the paired wires 74k, 75k constricting part of the electrical conductor means 60k, 61k extending from subscriber section 37 to the connector 59 in splice chamber 22.

Another component of the connector 86K is an insulative case 100k in which is embedded a pair of connectors 102k, 103k of which the tops provide terminals to which are attachable (and are shown as attached) a pair of tip and ring wires 104k, 105k. That wire pair extends in the building in which unit 20 is installed between unit 20 and a telephone station in an apartment of a tenant who is a telephone subscriber.

The connectors 102k, 103k in case 100k are coupled by way of a stub telephone cord 106k to a standard modular telephone plug 107k carried by cord 106k at its free end. Cord 106k is relatively stiff but is flexible enough to permit the plug to be plugged by hand into jack 91k or to be removed by hand from that jack to be separated therefrom as shown in FIG. 10. The insertion of plug 107k into that jack produces by connector 86 an electrical connection between wires 74k and 104k and between wires 75k and 105k. That electrical connection is, however, an interruptible one in that it can be disrupted by removal by hand of the plug from the jack. The connector 86k is thus characterized by an interruptible jack-plug jumper connection between the connectors 102k, 103k in case look and the conductors 94k, 95k in case 90k.

The combination of elements 100k, 102k–107k is known in the art as a customer bridge.

The other electrical connectors 86 incorporated in the interconnection assemblies of unit 20 serve like connector 86k to provide interruptible electrical connections between wires (a) coupled to and leading from the telephone networks and (b) terminals connectable to electric wires leading from telephone stations of subscribers.

Figure 3:
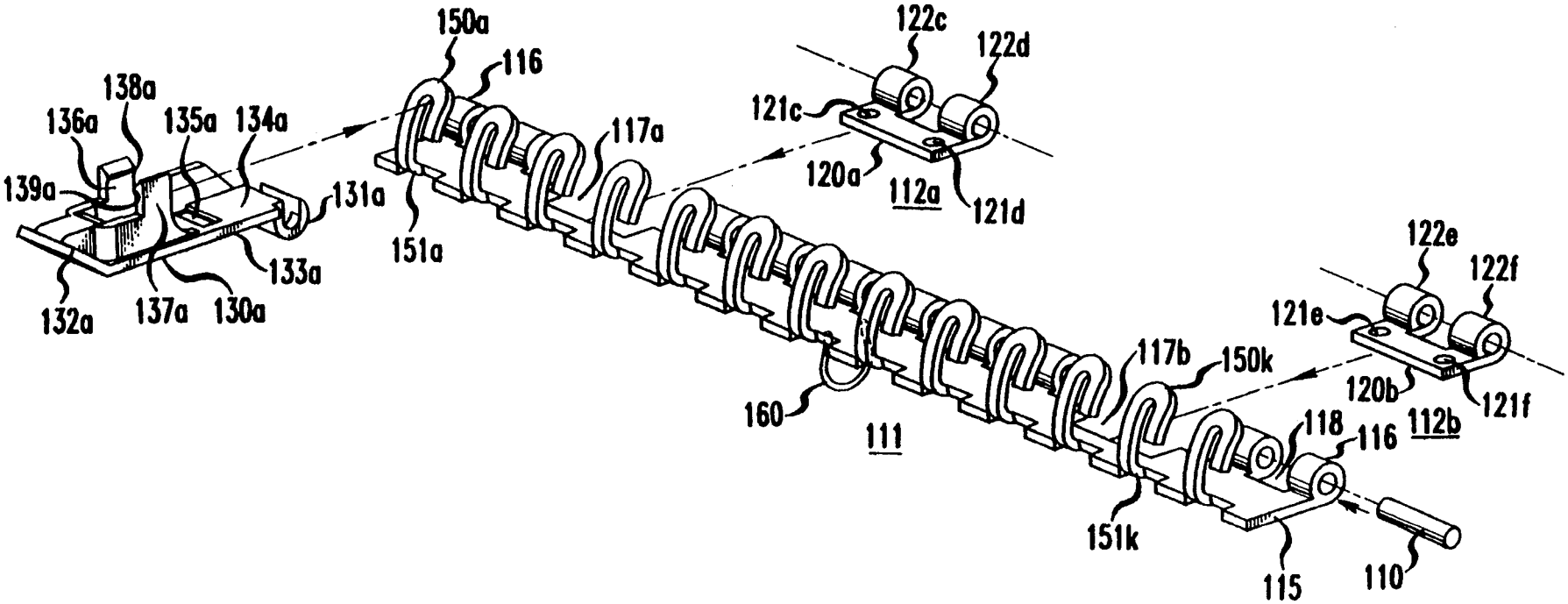
FIG. 3 is an isometric exploded view of the hasp mechanism included in one of interconnection assemblies of the FIG. 1 unit.

The hasp mechanism 87 included in interconnection assembly 85a comprises (a) a laterally extending hinge pin 110 (FIG. 3) longitudinally spaced from the row of connectors 86, (b) a first mounting means 111 extending laterally across unit 20 over the length of that row and (c) two second mounting means 112a, 112b disposed at laterally opposite ends of the mounting means 111.

The mounting means 111 is in the form of a metal rail having a laterally extending flat web 115 integrally united at its rear side with a plurality of laterally spaced rearwardly extending knuckles 116 having aligned lateral bores therein. The web 115 at its laterally opposite ends has format therein a pair of cutouts 117a, 117b extending into the web from its rearward edge and each laterally disposed between a pair of knuckles 116 of the mounting rail 111. The knuckles 116 are sufficiently rearwardly offset from the back edge of web 115 to provide working spaces 118 defined between those knuckles to the rear of that edge.

The mounting means 112a, 112b are mounting brackets comprising metal plates 120a, 120b which are counterparts of each other. Plate 120a has formed therein near its front a pair of screw holes 121c, 121d and is integrally united at its rear side with a pair of rearwardly extending knuckles 122c, 122d having lateral aligned bores formed thereto.

Figure 4:
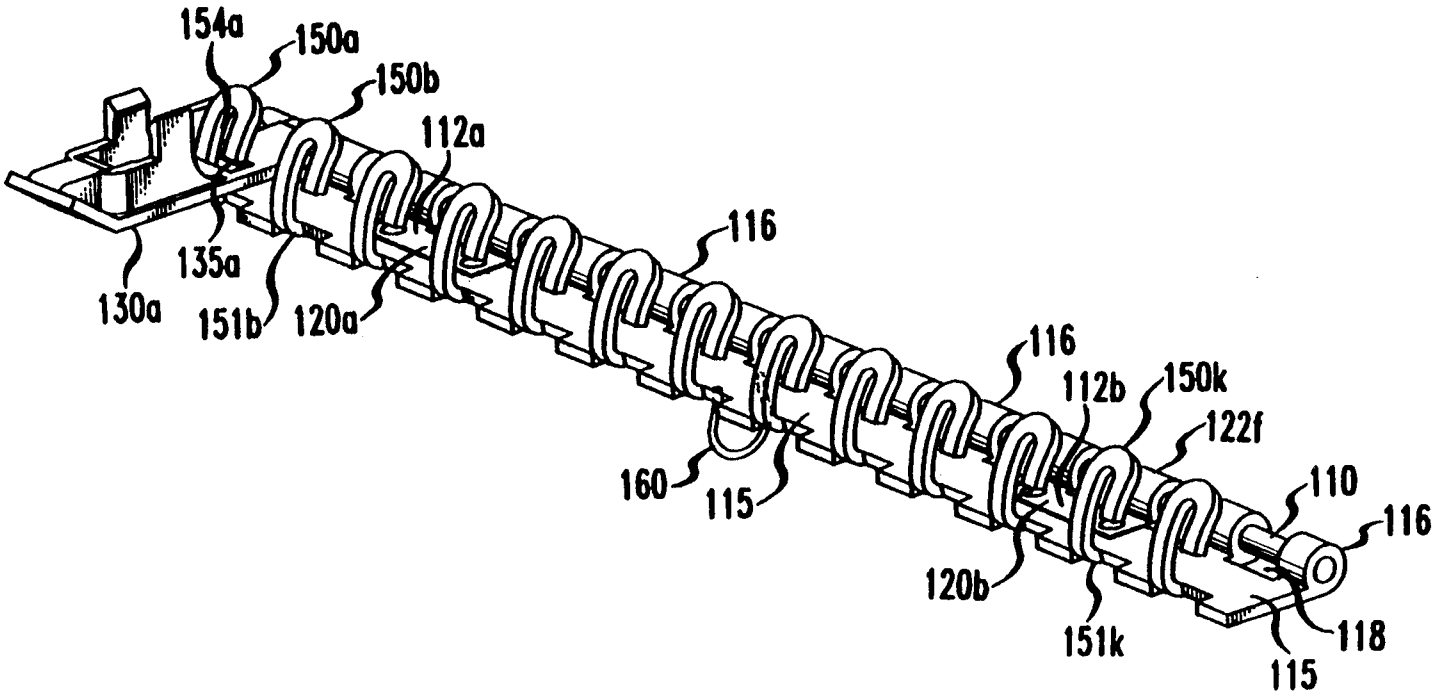
FIG. 4 is a view in assembled form of the FIG. 3 mechanism.

In the course of assembling the hasp mechanism 87, the plates of the mounting brackets 112a, 112b are placed within the respective ones of the cutouts 117a, 117b in mounting rail 111, so that the bores in the knuckles 122 of the brackets 112 align with the bores in the knuckles 116 of the rail 111. The hinge pin 110 is then passed through the bores of all the knuckles 116 and 112 to couple together the rail 111 and the brackets 112 and 112b in such manner that each of elements 111 and 112a, 112b is independently pivotable about the pin 110. Screws 123 (FIG. 5) are then passed through the screw holes 121 (FIG. 3) in brackets 112 into the slanting top wall 81a of pedestal 80a to fasten these brackets to that pedestal and thereby mount hinge pin 110 in translationally fixed position relative to the row of connectors 86 of assembly 85. The placement of the brackets 112 so that they fit in the cutouts 117 in rail 111 (FIG. 4) provides the advantage that, when hasp mechanism 87 is mounted on pedestal 80a as just described, the brackets may be on the same side of pin 110 as rail 111 (FIG. 5) while permitting the web 115 of rail 111 to lie flat against the pedestal wall 81a with which the brackets 112 abut.

The hasp mechanism 87 includes as other components a plurality of hasp leaves 130 respectively corresponding to the electrical connectors 86 in the row thereof on pedestal 80a. Leaf 130a is exemplary of the others of such connectors. The leaf 130a (FIGS. 3 and 11) is a plastic (i.e., synthetic resinous) leaf having a held end 131a, a free end 132a, inner and outer sides 133a, 134a and a slot aperture 135a longitudinally disposed centrally between those leaf ends and passing transversely through the leaf between its inner and outer sides. On the outer side of leaf 130a, between aperture 135a and free end 132, are a pair of laterally spaced upright plastic holding arms 136a, 137a resiliently deformable in the lateral direction towards and away from each other and having respective salient gripping ridges 138a, 139a on their sides towards each other. The function of arms 136a, 137a will be later described.

The leaf 130a at its held end 131a has a plastic knuckle 141a in which is formed a lateral passage 142a of "U" shape and in which the opening 143a of the "U" faces in the same direction as does the side 134a of the leaf. The innermost curved portion 144a of the "U" conforms to a circular cylindrical surface extending angularly around a lateral axis 147a for passage 142a. Inward of opening 143a and adjacent to the curved innermost portion 144a of the "U", the passage 142a has projections 145a extending laterally into the passage from its bounding walls on laterally opposite sides of the passage. Those projections 145a and the curved wall portion 144a of passage 142a cooperatively define, within knuckle 141 and for the pin 110, a socket or journal 146a which extends around the lateral axis 147a for somewhat more than 180°. The material of knuckle 141a which surrounds the passage 142a is resiliently deformable. Accordingly, the socket 146a is a resiliently expansible socket adapted by a snap-fitting action to selectably be attached sidewise to pin 110 to be retained thereon and pivotably coupled thereto or, alternatively, to be detached sidewise from pin 110 and separated therefrom.

The plastic hasp leaves 130 are incorporated into the hasp mechanism 87 by snap-fitting the sockets 146 of the leaves onto lengths of the pin 110 intervening places at which the pin passes through the knuckles 116 of the mounting rail 111 or knuckles 122 of the mounting brackets 112. To be able to so snap fit the leaves onto the pin is a convenience since it would be difficult to align all the sockets in the leaves with all the bores in knuckles 116 and 122 and then pass the pin 110 through all of them at one pass.

The leaf sockets 146 when so snap-fitted into pin 110 are resiliently expanded and strained to cause each leaf to grip the pin and produce friction therewith which normally holds the leg stationary in its last set position, but which friction can be overcome by hand force to shift the leaf away from that position.

Figure 11A:
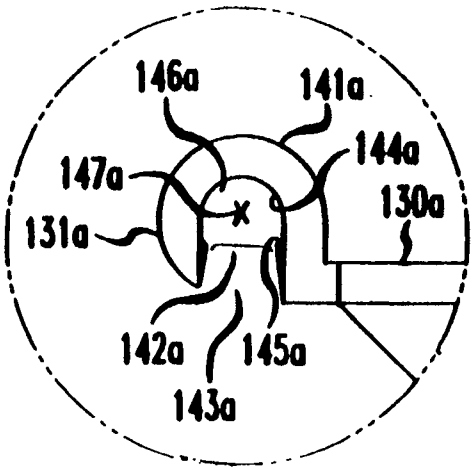
FIG. 11A is a further enlarged view of the knuckle of the hasp leaf shown in FIG. 11.
Figure 11:
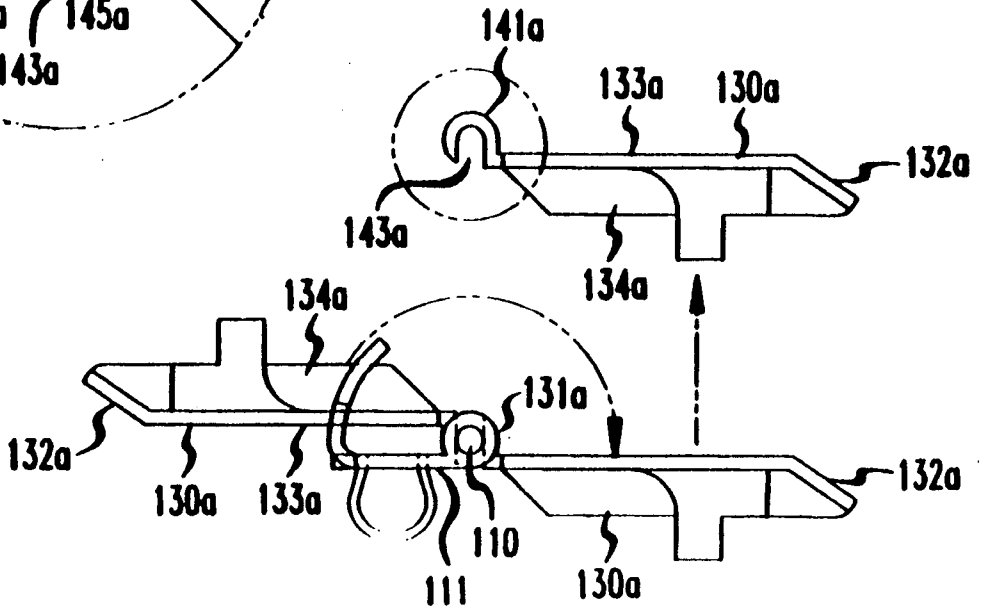
FIG. 11 is an enlarged front elevation showing two positions of one of the hasp leaves included in the mentioned interconnection assembly of the FIG. 1 unit.

The leaves 130 when so coupled to the pin 10 are ordinarily in the positions represented by the leftward position of leaf 130*a* in FIG. 11, and in which the held ends 131 of the leaves are received in the working spaces 118 beneath pin 10 (FIGS, 3 and 4), the openings 113 of the passages 142 in the knuckles 141 of the leaves are outward of the pin 10 and face outward away from pedestal 80*a*, and the bodies of knuckles 141 are beneath the fixed pin 10 so that the held ends 131 of the leaves are prevented by the pin from being displaced upwards to detach the leaves from the pin. The leaves 130 are, however, independently pivotably coupled to the pin 10 so as (if not prevented) to be angularly movable about the pin in transverse-longitudinal planes respective to the leaves. Therefore, if not prevented (ordinarily they are prevented as later described), any of the hasp leaves 130 can be angularly moved from a position represented by the leftward position shown for leaf 130*a* in FIG. 11 to the rightward position shown for that leaf in that FIG. 11. When, however, any of leaves 130 is moved to that rightward position, the opening 143 for the socket 146 of the leaf is shifted from facing outward to facing inwards towards pedestal 80*a*, the pin 10 is no longer interposed between the knuckle 141 and the socket opening 143 and the held end 131 of the pin can, therefore, by a reverse snap fitting action, be disengaged from the pin 10 to free the leaf 130 therefrom. Such removal of the hasp leaves 130 of hasp mechanism 105 may from time to time be necessary in order to remove damaged leaves or for other reasons.

Returning now to the mounting rail 111 of hasp mechanism 87, that rail has integrally joined to the front side thereof the base ends 151 of a plurability of hasp staples 150 respectively corresponding to the plurality of hasp leaves 130. These staples are bent in relation to the web 115 of rail 111 to extend, transversely of the plane of that web, outwardly from the pedestal 80*a*. The staples 150 are unconventional in that they do not, as usual, form closed loops with their mounting by being connected on both sides of the staple at its base to such mounting. Instead, the staples 150 of hasp mechanism 87 are each in the form of a hook in that each such staple extends from the base end 151 transversely outward and then bends back on itself to extend transversely inward for a distance and then terminates in a free end 152 separated by a gap 153 from the mounting web 115 with which the base end 151 of the staple is united. Such hook configuration of all the staples 150 is exemplified by the hook shape of the staple 150*e* shown in FIG. 9.

Figure 6:
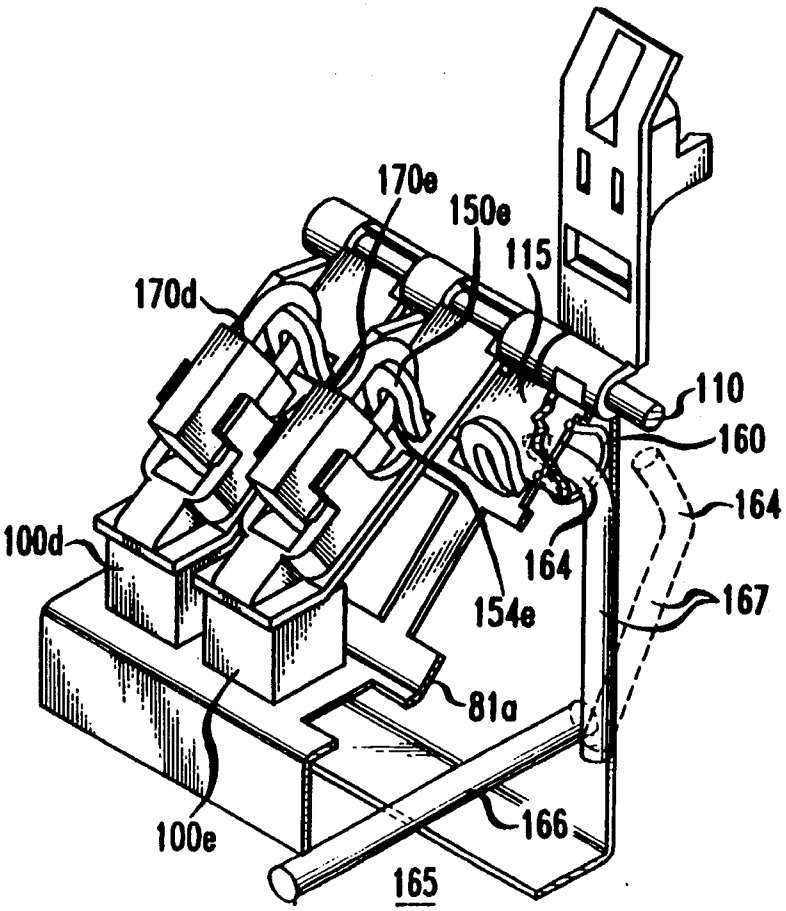
FIG. 6 is another isometric view of a subassembly of such assembly.

The hook staples 150 carried by the hinged rail 111 register with the slot apertures 135 in their respectively corresponding hasp leaves 130 so that each such staple can be inserted into the aperture of the corresponding leaf by closing relative movement between that leaf and the mounting rail 111. When, as exemplified by the showing of staple 150*e* in FIG. 9, any such staple 150 is so inserted, the staple extends from its base end 151 on the inner side 133 of its corresponding leaf through and beyond the aperture 135 in that leaf to have a portion 154 of the staple project outward of the outer side 134 of the leaf. Ordinarily, as exemplified by the showing of hasp staple 150*e* in FIG. 6 (and in contradistinction to the showing of that staple in FIG. 9), when a staple 150 is inserted into the aperture 135 of its corresponding hasp leaf 130, the fret end 152 of the staple is transversely positioned with such aperture between the inner and outer sides of the leaf so as, as shown in FIG. 6, not to be visible.

Figure 5:
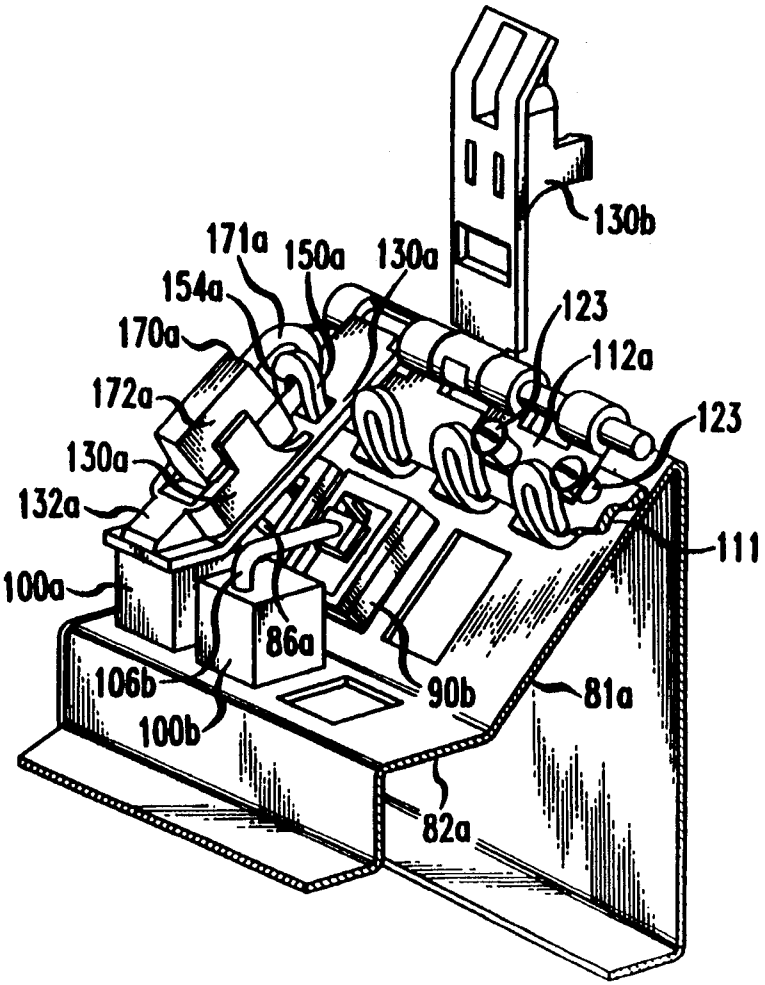
FIG. 5 is an isometric view of a broken-away subassembly of one of the mentioned interconnection assemblies of the FIG. 1 unit.
Figure 8:
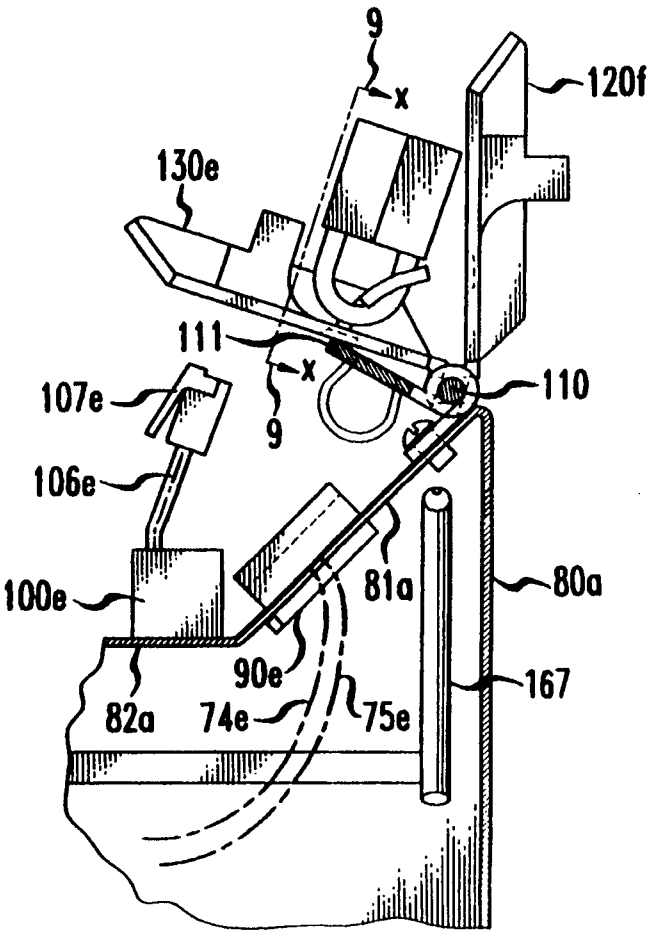
FIG. 8 is a front elevation, taken as indicated by the arrows 8—8 in FIG. 7, of the subassembly shown in FIG. 7.
Figure 7:
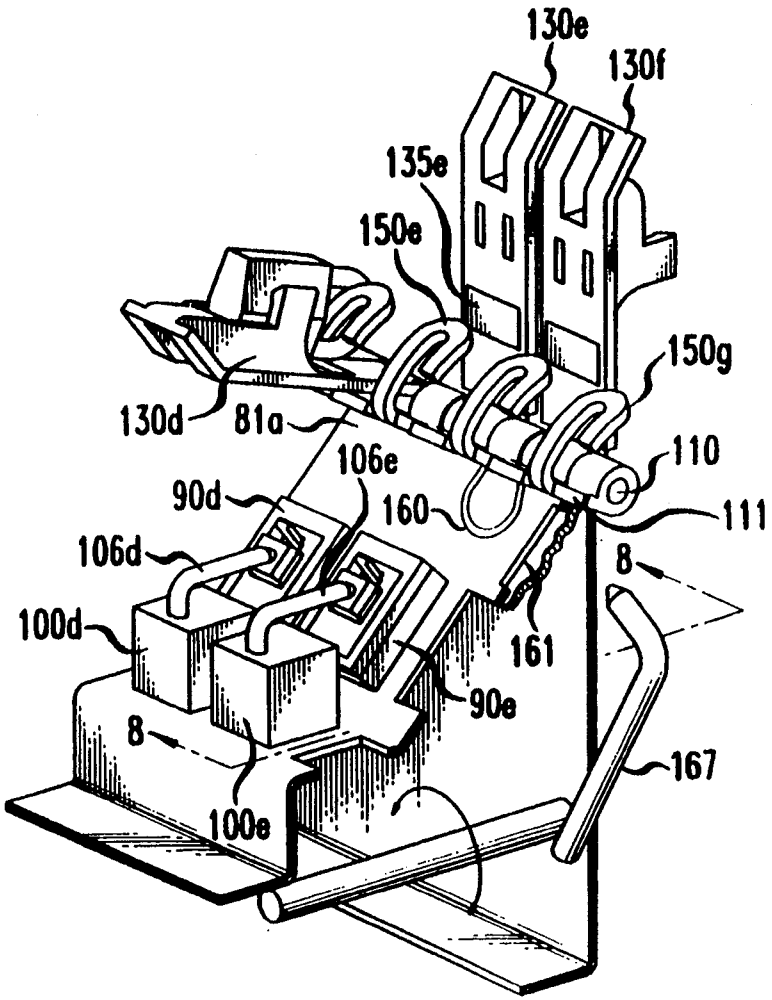
FIG. 7 is still another isometric view of a subassembly of the interconnection assembly.

The rail 111 is a carrier not only of the hasp staples 150 but also of a U-shaped metal retainer loop 160 mounted at a laterally central position on the inner side of rail web 115 to project transversely therefrom in the opposite direction to that of staples 150. In contrast to these hook staples, retainer loop 160 is united at its base by both of its opposite ends to the web 115 to form with the web a fully closed geometric loop. The loop 160 registers with a slot 161 (FIG. 7) through pedestal wall 81*a* to be insertable into that slot by pivotal movement of rail 111 about pin 10 which brings the rail web 113 into contact with the outer side of such wall (FIG. 5). When the loop 160 is fully inserted into slot 160, a portion of such loop projects out beyond the inner side of wall 81*a* into the interior space enclosed within pedestal 80*a* (FIG. 6).

Associated with retainer loop 160 is a finger 164 (FIG. 6) forming part of a mechanical linkage 165 also comprising a horizontal, angularly movable shaft 166 extending longitudinally in muting space 30 (FIG. 2) over the length of subscriber section 37 between right- and left-hand ends of the shaft, a right-hand crank arm 167 fixedly joining the finger 164 to the shaft 166 at its right-hand end, a left-hand crank arm 168 extending from the left-hand end of shaft 166 upward into the interior or pedestal 80*b*, and a horizontal handle 169 fixedly joined to arm 168 at its top and extending from said top leftward through a slot (not shown) in the left wall of pedestal 80*b* and in partition 35 to have a part projecting into the space above shelf 25 in network section 36. Such projecting part of handle 169 provides a control for linkage 165 which, by virtue of being disposed in that network section space, can be cut off from being accessed by anyone other than telephone network personnel having a key to the padlock 50.

By shifting handle 129 in network section 36 leftward and rightward (looking in FIGS. 1 and 2 from section 36 towards section 37), the finger 164 is, through angular movement of linkage 165, correspondingly shifted leftward and rightward from, respectively, its phantom dotted line position and its solid line position (both shown in FIG. 6) to, respectively, its solid line position and back to its dotted line position. When finger 164 is in its shown solid line position (FIG. 6), the finger is inserted inside retainer loop 160 to hold the mounting 111 at the inner end of a range of movement of such mounting relative to its support means provided by pedestal 80*a*. Such range of movement is realized by angular movement of the mounting 111 about the hinge pin 110 to which it is pivotably coupled. When, however, the finger 164 is shifted from the solid line position to its phantom dotted line position (FIG. 6), the finger is removed from the inside of retainer loop 160 and the mounting 111 is thereupon released to be angularly movable transversely outward from its previously held inward position to positions at which (FIG. 7 and 8) the retainer ring 160 is raised through slot 161 to be above pedestal wall 80*a*, and the mounting rail 111 is displaced outwardly from that wall.

USE OF EMBODIMENT

When BEP unit 20 is installed and in normal use in an apartment building, the described electrical connectors 86 provide respective electrical connections between tip and ring wire pairs 104, 105 leading from telephone stations of various telephone subscribers in the building and tip and ring wire cone pairs 57, 58 leading from the telephone network serving unit 20. The connections from connectors 86 to network wire pairs 57 and 58 are provided through the local electrical conductor means 60, 61 in the unit.

It may happen that telephone service at one of these stations may be interrupted and, in that case, the telephone subscriber of that station may wish to check to see whether the fault resides in his/her own wire pair 104, 105 or in the telephone network. He/she may do so by linking his/her subscriber's telephone set to unit 20, removing the plug 107 of the subscriber's connection 86 from the jack 91 thereof (see FIG. 10) and inserting the plug at the end of the cord of such telephone set into jack 91. Upon so doing and hearing a dial tone, the subscriber will know that the fault resides in the telephone set or in the wiring inside the building constituted of the particular wire pair 104, 105 assigned to subscriber. If no dial tone is then heard, the subscriber will know that the fault resides in the local telephone network or in wiring for which the local network is responsible for its maintenance.

The above described features of the connectors 86 of unit 20 that the connections provided thereby are interruptible to permit telephone sets to be directly plugged to wiring for which the local network has maintenance responsibility is an advantageous feature because it permits determination of where the fault resides without the making of trips by a network technician which turn out to be unnecessary because the fault resides in, say, a subscriber's telephone set. Such interruptible connections can, however, also be disadvantageous in the respect that if a telephone subscriber is unscrupulous, he can plug his telephone set at unit 20 into the jack of a connector assigned to another subscriber and have the costs of the calls made over that set billed to the unsuspecting other subscriber. Therefore, it is important that in unit 20 the connectors 86 with their interruptible electrical connections be made tamperproof in the sense that access to any such connector by an unauthorized person be impeded.

Such tamperproofing of the connectors 86 is effected in a manner as follows. In the unit there is utilized a plurality of access control means which respectively correspond to the plurality of connectors, and of which each access control means is independently selectably movable by hand between first and second positions at which, respectively, that access control means impedes and freely permits access to the correspondinging connector. In the exemplary embodiment 20 of the invention, each such access control means is provided by one of hasp leaves 130 which is pivotable about pin 10 between an inner angular position at which the free end 132 of the leaf is at the location of the corresponding connector to impede access thereto (see hasp 130*a* in FIG. 5) and the free end 132 of the leaf is away from that connector to freely permit access to it.

In order, however, for the hasp leaves 130 to perform their access impeding function, they must be maintained in their first positions, and this is selectably done in unit 20 by a plurality of fastening means in the form of hasp staples 150, by the use of respective padlocks 170 for such staples and by holding mounting rail 111 inward by passage of finger 164 through loop 160 on the rail.

More specifically, with the rail 111 so held inward by the finger 164 through loop 160 so that the web 115 of the rail abuts the outer side of pedestal wall 81*a*, the staples 150 on the rail become fixed in position relative to the pedestal to be in an enabled condition to lock the leaves 130 in their first positions with the help of padlocks. With the staples so fixed in position, leaves 130 are moved by hand as necessary, and against the friction produced by their resiliently expanded sockets 146, to effect between the elements 130 and 150 closing relative movements providing insertion of the staples into the slots 135 in the hasp leaves and consequent projections of portions 154 of these staples out beyond the outer sides of the leaves.

With the leaves 130 being so disposed in relation to the fixedly positioned staples, each telephone subscriber to whom is assigned a particular connector 86 having a corresponding leaf 130 and staple 150 then attaches a padlock 170 to the staple's portion 154 projecting from the leaf by closing the shackle 171 of the padlock on that staple portion. For example, the subscriber to whom is assigned that connector 86*a* closes the shackle 171*a* of his padlock 170*a* in the portion 154*a* of staple 150*a* projecting outward of the hasp leaf 130*a*. Thereafter, the padlock is moved out of the way by swiveling it around the staple portion 154*a* to place the padlocks' body 172*a* between the upstanding resilient arms 137*a*, 138*a* on the leaf so as to be firmly gripped by those arms.

With the padlocks 170 being so closed on the portions 154 of staples 150 projecting out from their corresponding leaves 130, the padlocks prevent opening relative movement between the base ends 151 of the staples and the leaves except for perhaps a small amount of play making no difference. It follows that, if then the staples are held as described in fixed position relative to pedestal 80*a* by the maintaining of mounting rail 111 in abutment with pedestal wall 81*a* by the passage of finger 164 through loop 160, then the hasp leaves will be locked (with insignificant play at most) at their first positions at the locations of connectors 86 to impede access to these connectors until released from such first positions. With the hasp leaves 130 being so locked in their first positions, it is impossible or difficult for a subscriber having a connector 86 assigned thereto to be victimized by having another person plug a telephone set into the jack of that connector and then making telephone calls charged to that subscriber.

Situations arise, however, in which it is necessary for a technician from the telephone network to have access to one or more of the connectors 86. To obtain such access, the technician first unlocks the padlock 50 which secures the cover 45 enclosing the space above shelf 25, lifts that cover, and then moves from left to right the handle 169 for the linkage 165. The resulting clockwise angular movement imparted to crank arm 168 is transmitted through shaft 166 to crank arm 167 to produce retraction of finger 164 from the loop 160 on rail 111. As a result of such retraction, the rail 111 is freely pivotable by hand around pin 110 well outward from its former position, the raft carrying with it in such outward movement all the hasp leaves 130, most or all Of them being then locked with the rail by padlocks 170. By such outward movement, all of the leaves 130 are shifted to second positions therefore freely permitting access to their associated connectors 86 by the technician. When that person no longer has need for such access, the steps described above are performed in reverse to relock the leaves 130 in their first positions at which they impale access to the connectors. From what has been said, it will be clear that the linkage 165 in conjunction with parts of mounting rail 111 constitutes an exemplary means for overriding the locking of the hasp leaves in their first position by changing the hasp staples 150 from having an enabled condition (in which they can, in conjunction with padlocks 170, maintain the leaves in that first position) to having a disabled condition in which such staples can no longer do so with or without such padlocks.

A situation which may require intervention by a telephone network technician is when a subscriber leaves the building in which unit 20 is installed without removing the subscriber's padlock from the connector 86 formerly used by that person. In such case, the padlock can be removed by the technician as follows.

As earlier stated herein, ordinarily the free ends 152 of the hook staples 150 are positioned within the apertures 135 of the corresponding hasp leaves 130 between the inner and outer sides 133 and 134 thereof. To amplify on such statement, such staple ends 152 are so positioned within the hasp leaf apertures when the leaves 130 are, as described, in their first positions to impede access to their corresponding connectors 86. When the staple free ends are in such apertures, a padlock closed on a projecting portion 154 of the hook staple 150 cannot be removed from that staple without opening the padlock, but that latter act can't be done because the subscriber has gone off with the key. Moreover, the the hasp leaves 130 being locked in their first position, it is not possible to produce between any leaf 130 and the mounting rail 111 a closing relative movement which would shift the free end 152 to the corresponding staple far enough outward of the outer side of the leaf to permit the padlock's shackle to escape through the resulting gap between such free end and outer side. That is so because, on the one hand, the raft 111 is held in its inward position by engagement of its loop 160 with finger 164 so that the rail cannot move significantly towards that leaf 130 and, on the other hand, the free end 132 of such leaf is in abutting contact with part of the associated connector 86 so as to be stopped by that contact from moving towards the raft 111.

Figure 9:
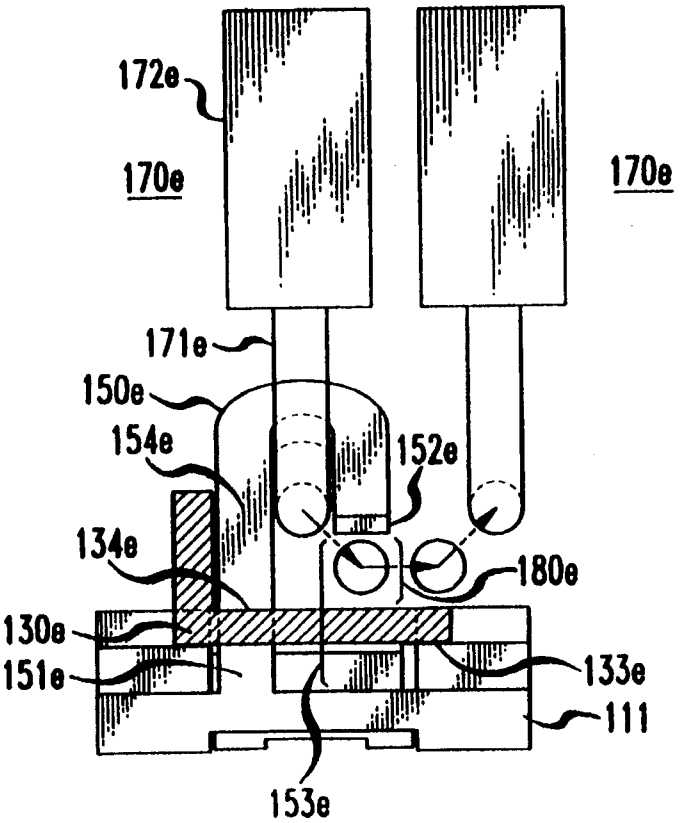
FIG. 9 is an enlarged left side elevation, taken as indicated by the arrows 9—9 in FIG. 8, of the subassembly shown in FIG. 8.

Upon, however, the technician manipulating linkage 165 to release rail 111 as earlier described from being held in its inward position, the foregoing restriction on producing closing relative movement between rail 111 and any hasp leaf 130 no longer applies. To wit, when rail 111 is so released and moved well outward from its former held position, carrying with it all the hasp leaves 130, all of such leaves become widely separated from their associated connectors 86 and, are, therefore, not stopped by contact with such connectors from undergoing closing movements around pin 10 towards rail 111. Hence, any particular one of such leaves 130 can be pressed towards the rail to produce therebetween a closing relative movement displacing the free end 152 of the corresponding hook staple 150 far enough out beyond the outer side of that leaf to produce between that end and side a gap 180 (FIG. 9) large enough to permit sidewise passage through it of the shackle 171 of the padlock 170 closed on that staple. That padlock can therefore be removed from such particular staple without unlocking the padlock. Concurrently, the other leaves are held by the friction between their resiliently expanded sockets and pin 110 in the positions last assumed by such leaves so as not to casually undergo any closing relative movement with rail 1111 which would permit escape of the padlocks locking down those other leaves from the staples 150 on which those padlocks are closed. An example of removing a locked padlock from a staple to which the padlock is attached is depicted in FIG. 9 for the hasp leaf 130*e*, staple 150*e* and padlock 170*e*.

The above-described embodiment being exemplary only, it is to be understood that additions thereto omissions therefrom and modifications thereof can be made without departing from the spirit of the invention. For example, without restriction, while the exemplary embodiment described above employs a hasp mechanism common to a plurality of electrical connectors, the invention in one or more of its aspects comprehends arrangements comprising a hasp device respective to only one such connector and utilized to render such connector more secure against unauthorized access and, also, arrangements comprising plurality of such hasp devices respectively corresponding to such plurality of connectors and individual to each of them in the sense of not being common to any two or more of them.

Accordingly, the invention is not to be considered as limited save as is consonant with the recitals of the following claims.

I claim:

1. A hasp device comprising a laterally extending hinge pin, first mounting means for mounting said pin on a support therefor, and having at the rear thereof a plurality of knuckles by which said first means is pivotably coupled to said pin, a hasp leaf pivotably coupled to said pin to be angularly movable thereabout, said leaf having inner and outer sides and an aperture extending therethrough between said sides, second mounting means on the inner side of said leaf and having at the rear thereof a plurality of knuckles by which said second mounting means is pivotably coupled to said pin, and a hasp staple having a base end affixed to said second mounting means and insertable from the inner side of said leaf through and beyond said aperture to have outward of the outer side of said leaf a projecting portion to which is securable a padlock by closing of said padlock on said portion, a padlock as so closed on said portion limiting opening relative movement between said leaf and said base end of said staple.

2. A hasp device according to claim 1 in which said first and second mounting means respectively comprise first and second members each hinged by said pin and extending away therefrom, and in which one of said members has at least one cut-out therein adjacent said pin and the other of said members is nestable in said cut-out.

3. A hasp device according to claim 1 in which said second mounting means is pivotable about said pin inward and outward over a range relative to said support when said pin is mounted thereon by said first mounting means, and said device further comprises retainer means disposed on said second mounting means and selectably engageable and disengageable with means coupled with said support to, respectively, hold said second mounting means at the inward end of said range and release said second mounting means from being so held.

4. A hasp device comprising a laterally extending hinge pin, a synthetic resinous hasp leaf pivotably coupled to said pin to be angularly movable about said pin, said leaf having inner and outer sides and an aperture extending therethrough between said sides, staple mounting means facing the inner side of said leaf and having at the rear thereof a plurality of knuckles by which said mounting means is pivotably coupled to said pin, and a hasp stable having a base end affixed to said mounting means and insertable from the inner side of said leaf through and beyond said aperture to have outward of the outer side of said leaf a projecting portion to which is securable a padlock by closing of said padlock on said portion, a padlock as so closed on said portion limiting opening relative movement between said leaf and said base end of said staple, said leaf being coupled with said pin at a held end of said leaf by a snap-fitting socket formed in said end and in which said pin is received, said socket having an opening on the outer side of said leaf, said opening for some angular positions of said leaf about said pin being on the outer side of said pin so that a portion of said held end of said leaf is on the inner side of said pin and said pin blocks outward displacement of said leaf end, and said opening for other angular positions of said leaf about said pin being on the inner side of said pin to permit removal of said leaf from said pin.

5. A hasp device according to claim 4 in which said socket is a resiliently expansible socket which, when said pin is received therein, produces friction between said pin and leaf which said leaf is yieldably held in angular positions relative to said pin to which said leaf was las set.

* * * * *